United States Patent [19]

Yu

[11] Patent Number: 4,706,342

[45] Date of Patent: Nov. 17, 1987

[54] PAPER CLIP

[76] Inventor: Wen C. Yu, 10318 Burgoyne, Houston, Tex. 77042

[21] Appl. No.: 58,375

[22] Filed: Jun. 5, 1987

[51] Int. Cl.[4] ..... B42F 1/02

[52] U.S. Cl. ..... 24/67.9; 24/67.3; 24/545

[58] Field of Search ..... 24/67.9, 67.3, 67 R, 24/67.1, 67.5, 67.7, 67.11, 545, 546; 281/15 B

[56] References Cited

U.S. PATENT DOCUMENTS

| | | | |
|---|---|---|---|
| 1,412,813 | 4/1922 | Aves | 24/545 |
| 2,329,974 | 9/1943 | Bennett | 24/67.11 |
| 2,464,015 | 3/1949 | Young | 24/545 |
| 3,194,248 | 7/1965 | Callies | 24/546 |
| 3,267,546 | 8/1966 | Kraft | 24/67.3 |

*Primary Examiner*—Victor N. Sakran

[57] ABSTRACT

A paper clip formed in one piece comprises: a top member with an opening, a bottom member having a lower portion and a tilted upper portion integrally connected by a joint portion at their front ends, and a web portion integrally connected the top member and the lower portion of the bottom member at their rear ends. The upper portion of the bottom member is confined within the opening of the top member and is located in substantially the same plane as is the top member whenever the clip is not being used. The upper portion of the bottom member is resiliently bendable toward the lower portion, and the top and bottom member are resiliently separable to receive and hold papers between substantially the entire bodies of the top member and the upper portion of the bottom members. The paper clip has a unique characteristic of distributing a uniform clamping force to the top and bottom members by constantly maintaining a parallel relationship between the top member and the upper portion of the bottom member.

3 Claims, 11 Drawing Figures

PAPER CLIP

BACKGROUND OF THE INVENTION

The present invention relates to a paper clip, and more particularly to a clip which is formed as one piece capable of providing an evenly distributed clamping force to firmly and releasably hold a multiplicity of thickness ranges of papers together. The conventional paper clips formed in a common plane can not accommodate relatively thick papers and will cause certain distortion of the papers due to the fact that their clamping members have a very limited range to extend and the clamping force is unevenly distributed.

SUMMARY OF INVENTION

According to the present invention, a paper clip formed as one piece comprises a top member and a bottom member which includes a tilted upper portion and a lower portion integrally connected by a joint portion at their front ends. The rear ends of the top member and the lower portion of the bottom member are integrally connected by a web portion. The utilization of a flexible upper portion coupled with the resiliently separable top and bottom members make it possible to provide a paper clip with a great flexibility to receive papers varying greatly in thickness and firmly and releasably hold them together by distributing a uniform clamping force to the clamping members.

The primary object of the present invention is to provide a simple paper clip which is capable of providing an effective clamping action to firmly and releasably hold a multiplicity of thickness ranges of papers together.

Another object is to provide such a paper clip which is very attractive and has the characteristics of distributing a uniform clamping force to the clamping members.

Still another object is to provide such a paper clip which is easy to use and suitable for a mass production with a relatively low cost.

A further object is to provide such a paper clip which will minimize the distortion of the papers and tearing problem during removal of the clip.

Further objects and advantages of the present invention will become apparent from a consideration of the drawings and ensuing description thereof.

BRIEF DESCRIPTION OF THE DRAWINGS

The present invention will now be explained with reference to the accompanying drawings, in which.

PREFERRED EMBODIMENT OF THE INVENTION

Figure 1:
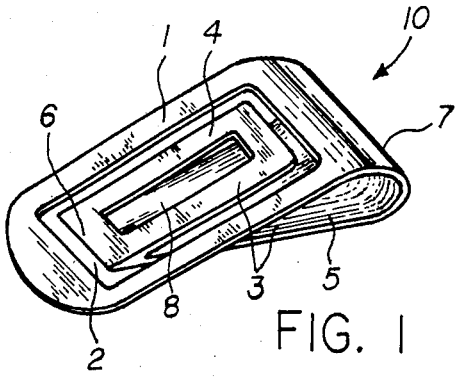
FIG. 1 is a perspective view of the paper clip according to the present invention.

Referring to the drawings, in particular FIG. 1, a paper clip 10 comprises: a top member 1 having an opening 2, a bottom member 3 including a tilted upper portion 4 and a lower portion 5 integrally connected by a joint portion 6 at their front ends, and an arcuate web portion 7 connected the top member 1 and the lower portion 5 of the bottom member 3 at their rear ends. The upper portion 4 provided with an opening 8 is shorter than the lower portion 5 and the lower portion 5 is shorter than the top member 1.

Figure 2:
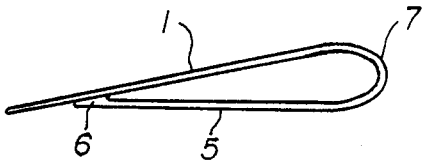
FIG. 2 is a side view of FIG. 1.
Figure 3:
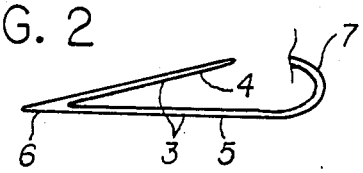
FIG. 3 is a side view of FIG. 1 showing particularly the complete bottom member without showing the top member.

Referring now to FIGS. 1, 2, and 3, the opening 2 of the top member 1 and the upper portion 4 of the bottom member 3 are formed to have substantially the same configuration with the opening 2 being proportionally larger than the upper portion 4 of the bottom member 3. The acute angle between the upper portion 4 and lower portion 5 of the bottom member 3 and the arcuate web portion 7 are formed in such a manner to permit the upper portion 4 to be confined within the opening 2 of the top member 1 and located in substantially the same plane as is the top member 1 and therefore, forming a substantially triangular space as shown in FIG. 2. This triangular space converges progressively toward the front ends of the bottom member 3. FIG. 2 shows the side view of FIG.1 in which the upper portion 4 is hidden by the top member 1. FIG. 3 shows the complete bottom member 3 without showing the top member 1.

Figure 10:
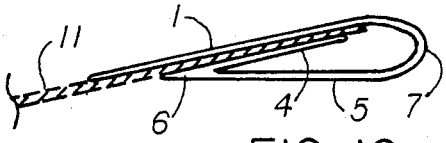
FIG. 10 is a side view of FIG.1 with a small amount of papers being clamped.
Figure 11:
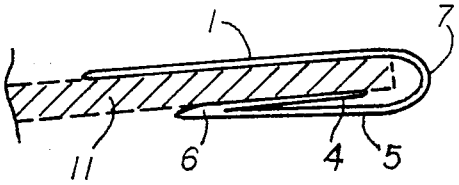
FIG. 11 is a side view of FIG.1 with a large amount of papers being clamped.

The joint portion 6 is formed to provide the upper portion 4 resiliently bendable toward the lower portion 5. The arcuate web portion 7 is formed to provide the top and bottom members 1, 3 with a strong resiliency of resisting separation from each other. The papers are received between the top member 1 and the upper portion 4 of the bottom member 3 as shown in FIG. 10 with a small amount of papers 11 and in FIG. 11 with a large amount of papers 11. As it can be seen in FIGS. 10 and 11, the joint portion 6 and the web portion 7 are formed in such a manner to enable the top member 1 and the upper portion 4 of the bottom member 3 to accommodate a multiplicity of thickness ranges of papers and firmly hold them therein by maintaining a substantially parallel to each other relationship. As a result, a uniform clamping force is distributed to the top and bottom members 1, 3 which will minimize the distortion of the papers being clamped.

Figure 4:
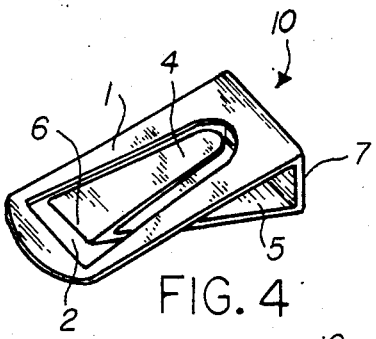
FIG. 4, 6, and 8 are perspective views of modifications of the paper clip showing different shapes and web portions.
Figure 5:
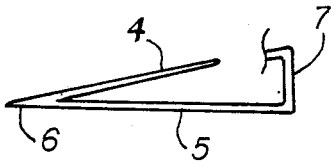
FIG. 5, 7, and 9 are side views of FIG. 4, 6, and 8 respectively, showing the complete bottom members.
Figure 6:
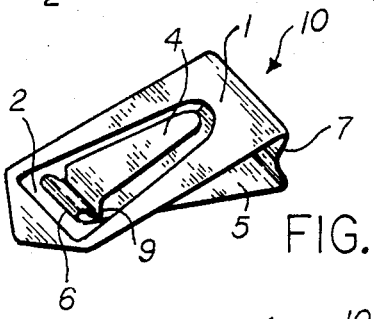
Figure 7:
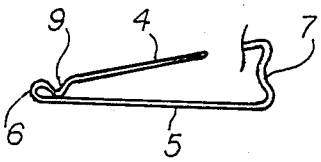
Figure 8:
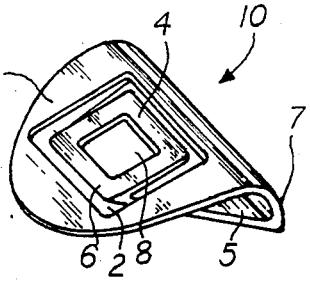
Figure 9:
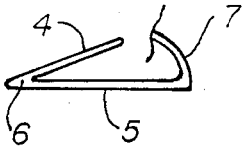

FIGS. 4 and 5 show another embodiment of the present invention with a flat web portion 7 and an upper portion 4 without any opening. FIGS. 6 and 8 illustrate other possible embodiments of the present invention with different curved web portions and clip shapes and FIGS. 7 and 9 are side views of FIGS. 6 and 8 respectively, showing specifically for the complete bottom member 3. The configuration shown in FIG. 6 is particularly suitable for a paper clip made of a metallic material such as steel in which the joint portion 6 includes an extended V-shapped member 9 above the lower portion 5 and connected to the front end of the upper portion 4 serving as a pivot.

It is obvious that the paper clip according to the present invention can be made of resilient plastic and metallic materials with various sizes to accommodate the maximum amount of papers desired to be clamped and the thickness of each part may be varied accordingly to provide the required strength to do the job, particularly in the various strategic parts of the joint and web portions 6, 7. The front end of top member 1, the rear end of the upper portion 4 and the joint portion 6 are formed to facilitate the entry and removal of the clip in order to minimize the potential problem of tearing the papers.

While the above description contains many specificities, these should not be construed as limitations on the scope of the present invention. Many other variations are possible, for example, the upper and lower portions 4, 5 of the bottom member 3 may be provided with large openings to save the material, and the bottom surface of the top member 1 and the top surface of the upper portion 4 may be provided with various kinds of non-uniform surfaces to facilitate preventing the sliding movement of the papers. Accordingly, the scope of the invention should be determined not by the embodiments illustrated, but by the spirit and scope of the following appended claims.

What I claim is:

1. A paper clip of resilient material comprising: a top member formed to provide an opening, a bottom member having a lower portion and a tilted upper portion integrally connected by a joint portion at their front ends forming an acute angle therein, the upper portion being shorter than the lower portion and the lower portion being shorter than the top member, and a curved web portion integrally connected the top and bottom members at their rear ends, the opening of the top member and the upper portion of the bottom member being formed to have substantially the same configuration with the opening being proportionally larger than the upper portion of the bottom member, the upper portion of the bottom member being resiliently bendable toward its lower portion and the top and bottom members being resiliently separable to receive and hold the papers between substantially the entire bodies of the top member and the upper portion of the bottom member, the curved web portion and the joint portion being formed in such a manner to firstly permit the upper portion of the bottom member to be confined within the opening of the top member and located in substantially the same plane as is the top member whenever the clip is not being used, and secondly, enable the top member and the upper portion of the bottom member to receive a multiplicity of thickness ranges of papers and firmly and releasably hold them therein by maintaining a substantially parallel to each other relationship.

2. A paper clip of resilient material comprising: a top member formed to provide an opening, a bottom member having a lower portion and a tilted upper portion integrally connected by a joint portion at their front ends forming an acute angle therein, the upper portion being shorter than the lower portion and the lower portion being shorter than the top member, and a flat web portion integrally connected the top and bottom members at their rear ends, the opening of the top member and the upper portion of the bottom member being formed to have substantially the same configuration with the opening being proportionally larger than the upper portion of the bottom member, the upper portion of the bottom member being resiliently bendable toward its lower portion and the top and bottom members being resiliently separable to receive and hold the papers between substantially the entire bodies of the top member and the upper portion of the bottom member, the flat web portion and the joint portion being formed in such a manner to firstly permit the upper portion of the bottom member to be confined within the opening of the top member and located in substantially the same plane as is the top member whenever the clip is not being used, and secondly, enable the top member and the upper portion of the bottom member to receive a multiplicity of thickness ranges of papers and firmly and releasably hold them therein by maintaining a substantially parallel to each other relationship.

3. A paper clip of resilient material comprising: a top member formed to provide an opening, a bottom member having a lower portion and a tilted upper portion integrally connected by an arcuate joint portion at their front ends forming an acute angle therein, the joint portion including an extended V-shapped member above the lower portion and connected to the front end of the upper portion serving as a pivot, the upper portion being shorter than the lower portion and the lower portion being shorter than the top member, and a curved web portion integrally connected the top and bottom members at their rear ends, the opening of the top member and the upper portion of the bottom member being formed to have substantially the same configuration with the opening being proportionally larger than the upper portion of the bottom member, the upper portion of the bottom member being resiliently bendable toward its lower portion and the top and bottom members being resiliently separable to receive and hold the papers between substantially the entire bodies of the top member and the upper portion of the bottom member, the curved web portion and the joint portion being formed in such a manner to firstly permit the upper portion of the bottom member to be confined within the opening of the top member and located in substantially the same plane as is the top member whenever the clip is not being used, and secondly, enable the top member and the upper portion of the bottom member to receive a multiplicity of thickness ranges of papers and firmly and releasably hold them therein by maintaining a substantially parallel to each other relationship.

* * * * *